US006772998B2

(12) United States Patent
Bebendorf

(10) Patent No.: US 6,772,998 B2
(45) Date of Patent: Aug. 10, 2004

(54) FENCE PANEL

(76) Inventor: Ronald William Bebendorf, 63 Michelangelo Cr., Mackenzie Qld 4156 (AU)

( * ) Notice: Subject to any disclaimer, the term of this patent is extended or adjusted under 35 U.S.C. 154(b) by 0 days.

(21) Appl. No.: 10/028,873

(22) Filed: Dec. 20, 2001

(65) Prior Publication Data

US 2002/0088968 A1 Jul. 11, 2002

(51) Int. Cl.[7] ..... E04H 7/16
(52) U.S. Cl. ..... 256/24; 256/31; 256/65.11
(58) Field of Search ..... 403/240, 245; 256/24, 21, 22, 19, 59, DIG. 5, 64, 65.11, 65.12, 65.02, 65.14, 31

(56) References Cited

U.S. PATENT DOCUMENTS

| | | | | | |
|---|---|---|---|---|---|
| 529,067 | A | * | 11/1894 | Fraser | 256/24 |
| 1,378,948 | A | | 4/1921 | Hage | 52/298 |
| 3,037,593 | A | | 6/1962 | Webster | 189/34 |
| 3,652,060 | A | | 3/1972 | Glover | |
| 3,747,965 | A | * | 7/1973 | Wing | 403/173 |
| 3,822,053 | A | | 7/1974 | Daily | 256/22 |
| 3,955,801 | A | * | 5/1976 | Soriero, Jr. | 256/65.13 |
| 3,963,219 | A | | 6/1976 | D'Amico | 256/24 |
| 4,133,154 | A | | 1/1979 | Ruzicka | 52/298 |
| 4,148,277 | A | | 4/1979 | Engle | 256/24 |
| 4,188,019 | A | | 2/1980 | Meredith | 256/24 |
| 4,198,034 | A | | 4/1980 | Svirklys | 256/65 |
| 4,477,059 | A | | 10/1984 | Willis | 256/65.11 |
| 4,962,914 | A | | 10/1990 | Taylor | 256/72 |
| 5,161,783 | A | | 10/1990 | German | 256/19 |
| 5,100,107 | A | | 3/1992 | Latta | 256/19 |
| 5,255,897 | A | | 10/1993 | Pepper | 256/24 |
| 5,372,354 | A | * | 12/1994 | Cacicedo | 256/22 |
| 5,447,290 | A | | 9/1995 | Workman | 256/59 |
| 5,628,495 | A | | 5/1997 | Gandara | 256/24 |
| 5,639,069 | A | | 6/1997 | McClure | 256/25 |
| 5,689,927 | A | * | 11/1997 | Knight, Sr. | 52/297 |
| 5,702,090 | A | | 12/1997 | Edgman | 256/19 |
| 5,848,502 | A | | 12/1998 | Schaefer | 52/165 |
| 5,938,184 | A | * | 8/1999 | DeSouza | 256/19 |
| 5,988,599 | A | | 11/1999 | Forbis | 256/24 |
| 6,039,307 | A | | 3/2000 | De Zen | 256/21 X |
| 6,041,486 | A | | 3/2000 | Forbis | 29/453 |
| 6,173,944 | B1 | * | 1/2001 | McCarthy | 256/19 |
| 6,345,809 | B1 | | 2/2002 | Bebendorf | 256/24 |

FOREIGN PATENT DOCUMENTS

| | | | |
|---|---|---|---|
| AU | 137015 | | 4/1999 |
| AU | 715021 | * | 1/2000 |
| AU | 142529 | | 12/2000 |
| AU | 734491 | | 6/2001 |
| AU | 742277 | | 12/2001 |

* cited by examiner

*Primary Examiner*—David Bagnell
*Assistant Examiner*—Kenneth Thompson
(74) *Attorney, Agent, or Firm*—Rudolf O. Siegesmund

(57) ABSTRACT

A fence panel comprised of sections which can be simply attached together without the need for any separate fasteners, connectors or the like. The fence panel has a reversible rail and tear out strips.

16 Claims, 5 Drawing Sheets

Partial Front View

Section a-a

Section b-b

Section c-c

Exploded Section a-a

FENCE PANEL

BACKGROUND OF THE INVENTION

This application claims priority benefits from Australian Patent No. 734491 filed on Jan. 4, 2001 and issued Sep. 27, 2001.

FIELD OF THE INVENTION

The present invention relates to a fence panel comprising sections which can be simply attached together without the need for any separate fasteners, concrete and the like. Fence rails can be inverted to accept alternate types of cladding. The fence panels are particularly suited for domestic applications but need not be limited to such.

DESCRIPTION OF THE PRIOR ART

The majority of house holders and professional fencing contractors are aware of the difficulties and time consuming process of constructing fences. A product that is quick and easy to construct and that is relatively inexpensive would be desirable to such people.

Fences are usually used in an urban environment around the perimeter of a property, as dividers between the front and back yards, and as swimming pool fencing. Gates are typically installed in the front of the property.

A very popular fence type is a paling fence. The material typically used for this type of fence is either a fencing grade rough sawn hardwood or treated pine. If a presentable and an easily painted finish is required it is desirable to arris all edges of these timbers. A number of specialized tools are necessary to achieve this result. Even with these tools this exercise is a time consuming and laborious job.

Generally fences are painted to improve both aesthetics and durability of the timbers. Usually a minimum of two coats of acrylic paint or an oil based stain is required to provide an acceptable finish. A third coat can be applied for a better finish and protection. Repainting is generally required every six or seven years. Painting again is a laborious and expensive process. If a tradesperson is instructed to paint the fence, the cost of painting often exceeds the cost of the fence.

A problem with using timber for fencing is its lack of durability and stability. Over a short period of time it may warp and split with resultant poor aesthetics. Timber is also susceptible to wet rot and termite damage. Also timber, particularly hardwood is becoming scarce and a socially unacceptable commodity.

SUMMARY OF THE INVENTION

It is the object of the present invention to provide a pre-finished fencing assembly which will overcome the above mentioned disadvantages and provide a useful or commercial choice. The present invention can also be dismantled in the reverse manner of assembly to enable ease of repainting or access of machinery for the purpose of landscaping, swimming pool building and the like.

The fence assembly comprises a plurality of post members, a plurality of rail members and a plurality of paling members. The post members are connected to the rail members and the rail members are connected to the paling members. The connection established between the post and rail members is through openings on the inside face of the post members and projections at the end of the rail. The connection between the paling members is established by passing the paling members through a plurality of openings in the rail members.

The post members and rail members, when connected, may be perpendicular with respect to one another. Also the rail members and paling members, when connected, may be perpendicular with respect to one another.

The post members may be used to locate the rail members. Typically the post member is formed from a rectangular hollow section and the rectangular hollow section may be formed from a sheet or plate of metal which has been configured to be hollow and elongate.

The post members may have a number of openings on the inside face. Typically there are six sets of two openings. Openings are spaced to allow stepping of fence rails on sloping sites. The six sets of two openings may be parallel. There may be two openings for every set of openings. An opening is typically rectangular in shape.

The bottom of the post member may be connected to a foot. Typically the foot is a precast concrete block. The block may have a cavity extending downwardly from the top wall to a depth suitable to hold the fence post. The cavity may be enlarged at one side to accept a holding wedge. These wedges may be formed from a composite material. The wedge will be typically rectangular when viewed in plane. It may be elongated, tapering and solid. The wedge will both secure the post at the required height and enable the post to be removable.

The rail members may also comprise rectangular hollow sections and these may also be formed from a metal sheet or plate which is configured to adopt a rectangular hollow section shape. Rail members may have a continuous tear out strip along the center of one edge.

The rail members may have a plurality of openings, one continuous opening, or both. The openings may extend along the length of the rail member. The openings may be in alignment. The openings are typically located on the top edge of the bottom rail, on the bottom edge of the top rail and through the top and bottom edges of the center rail. They may be rectangular in shape.

At the ends and at the sides of the rail members may be projections. These projections may be able to mate with the openings on the posts. The shape of projections permits the rails to be inverted.

The paling members may comprise of a pressed hardwood fiber board, vinyl or plastic which are configured to adopt a rectangular shape when viewed in plane. They may be elongate. They may be adapted to pass through the rail members.

The foregoing and other objects, features and advantages of the invention will be apparent from the following more particular description of a preferred embodiment of the invention, as illustrated in the accompanying drawings wherein like reference numbers represent like parts of the invention.

BRIEF DESCRIPTION OF THE DRAWINGS

An embodiment of the invention will be illustrated with reference to the accompanying drawings in which.

DESCRIPTION OF THE PREFERRED EMBODIMENTS

Figure 1:
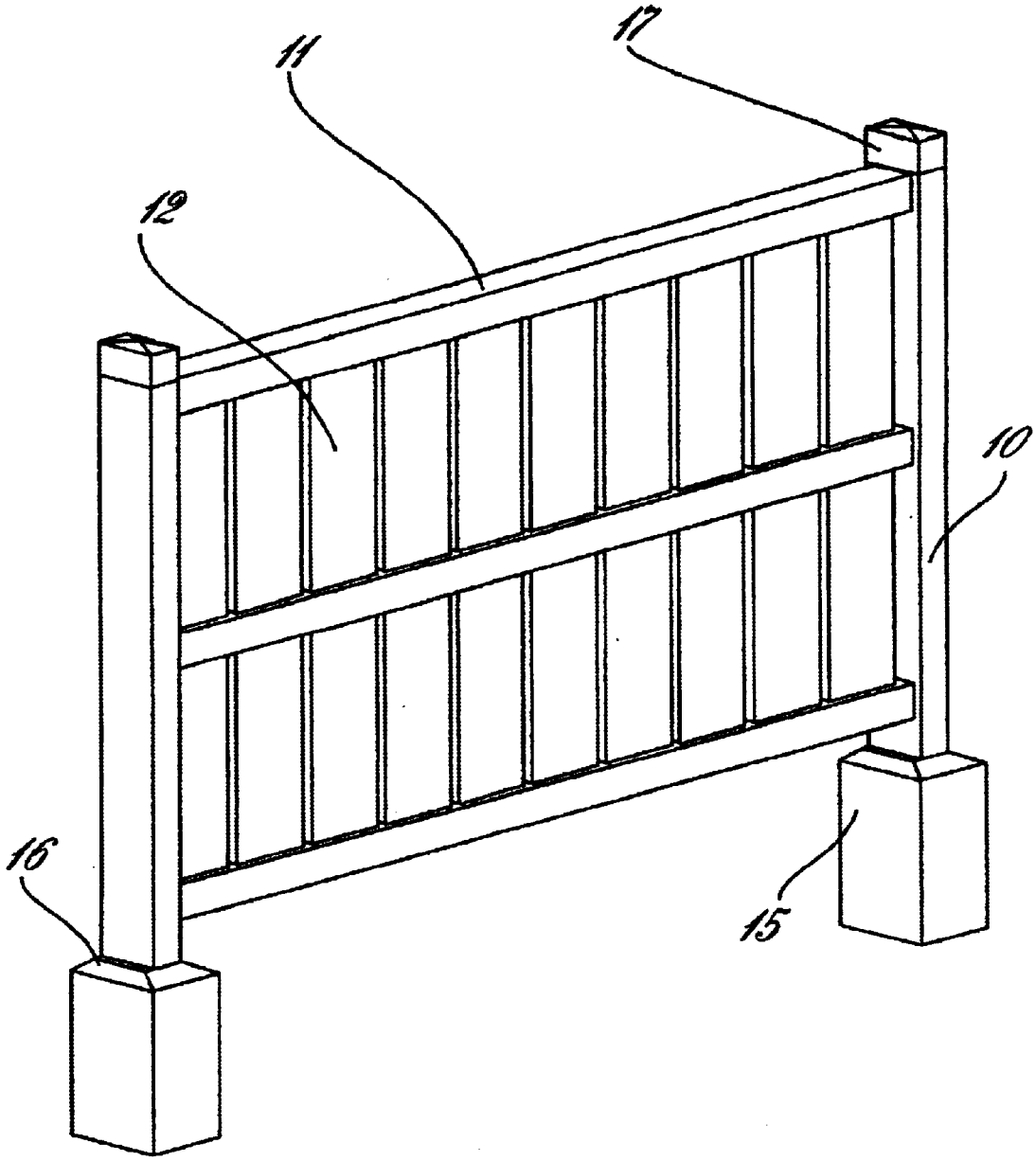
FIG. 1 illustrates a perspective view of a fence panel assembly according to an embodiment of the invention.
Figure 2:
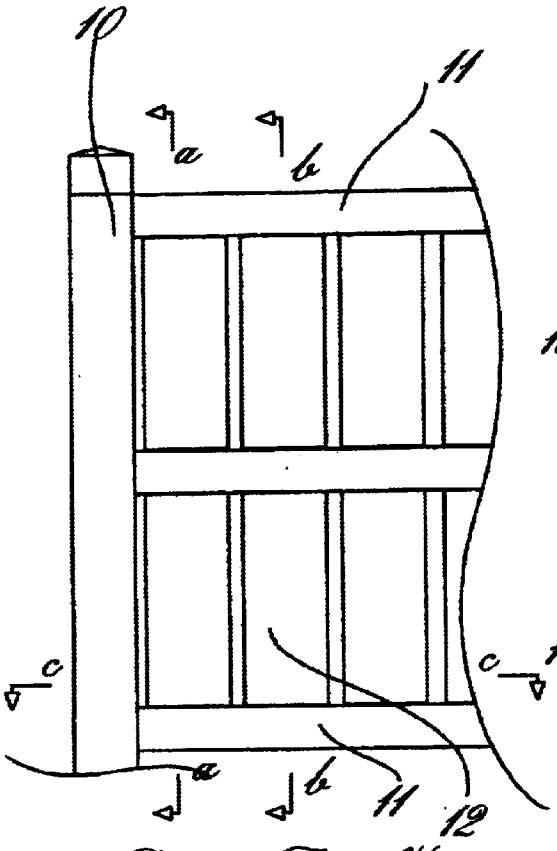
FIG. 2 illustrates the inside face of a post member according to FIG. 10.
Figure 2:
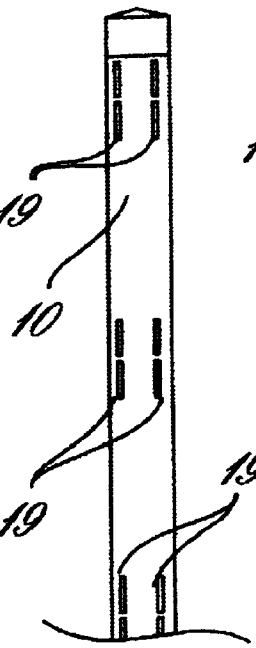

Referring to FIG. 1 there is shown a fence assembly comprising a foot 15, a wedge 16, a post member 10, a rail member 11, a paling member 12 and a capping member 17.

Figure 5:
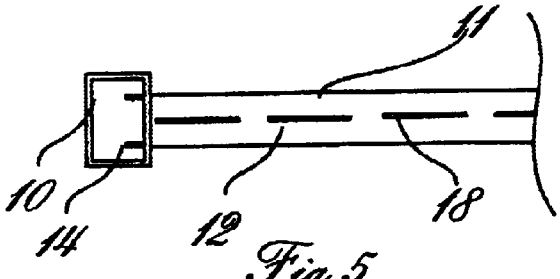
FIG. 5 illustrates a fragmented enlargement of a fence rail member attached to a post according to FIG. 3.
Figure 10:
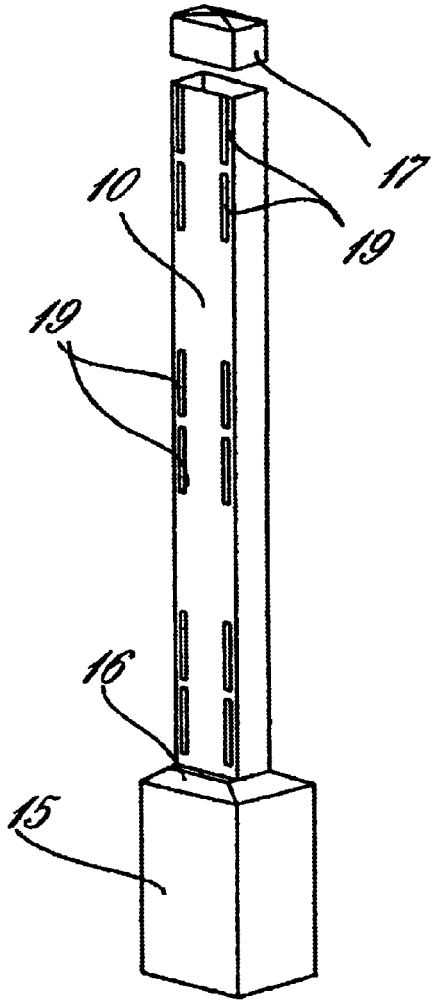
FIG. 10 illustrates a view of a post, post cap, post wedge and post foot according to FIG. 1.
Figure 11:
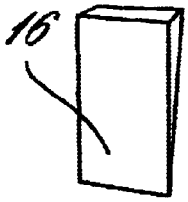
FIG. 11 illustrates a perspective view of a foot wedge.
Figure 12:
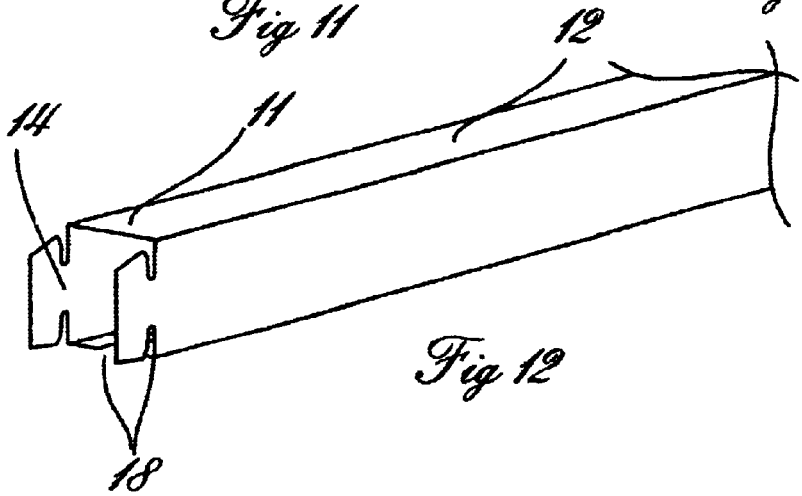
FIG. 12 illustrates a view of a top rail.

Referring to FIG. 5 and FIG. 10, it can be seen that post member 10 is formed from a rectangular section that is hollow and elongate. Post member 10 has six thin sets of two post openings 19 located on its inner walls. Post openings 19 are rectangular in shape and the two top post openings extend to the top of post member 10. Post openings 19 are arranged to allow for the stepping of rails on sloping sites. Above post member 10 is capping member 17 that is rectangular in shape with a top that is raised at the center.

Referring to FIGS. 3, 7, 8 and 12 it can be seen that rail member 11 is formed from a rectangular hollow section. Rail member 11 may have continuous tear out strip 21 (see FIG. 13) along the center of one edge. Rail member 11 has rail openings 18 located along the length of the rail member 11. Rail openings 18 are rectangular in shape and are equally spaced along the length on the edge of rail member 11. The center rail has these openings on both edges which align with one another. Bottom opening is continuous. Extending along at the ends of the side walls of rail member 11 is hooked shape projection 14. The hook shape of projection 14 permits rail member 11 to be inverted.

Referring to FIGS. 1 and 5 it can be seen that paling member 12 is rectangular in shape when viewed in plane. Paling member 12 is elongate and solid.

Figure 9:
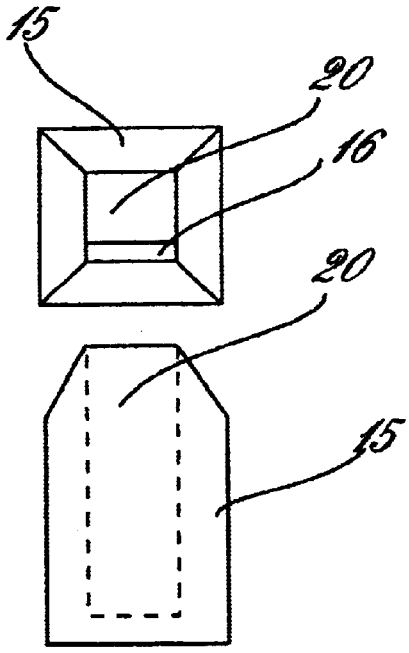
FIG. 9 illustrates a top/side view of a post foot.

Referring to FIGS. 9 and 10 it can be seen that foot 15 is a rectangular block. Extending downwardly from the top wall of foot 15 is cavity 20. Cavity 20 increases in size part way down one side. Cavity 20 is able to locate post member 10. Wedge 16 is used to secure post member 10 to foot 15 at the required height.

Figure 7:
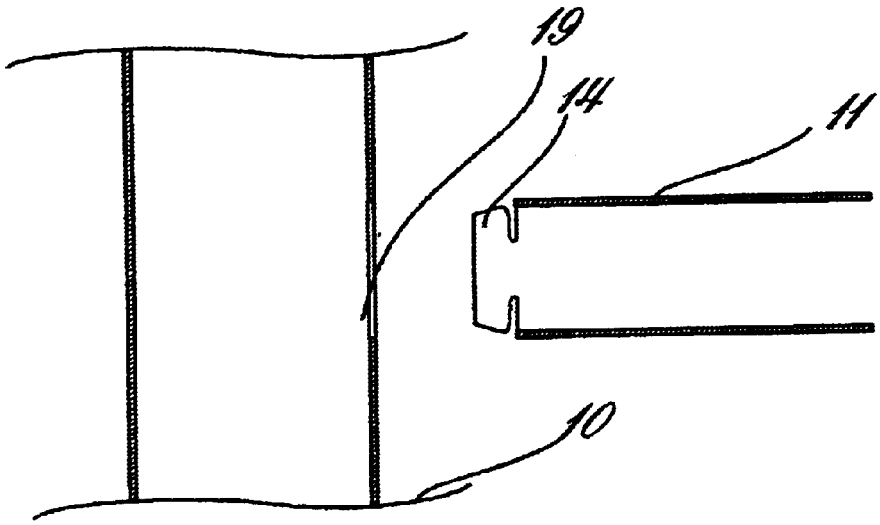
FIG. 7 illustrates a technique used to couple the center and bottom rail member to a post according to FIG. 3.
Figure 7:
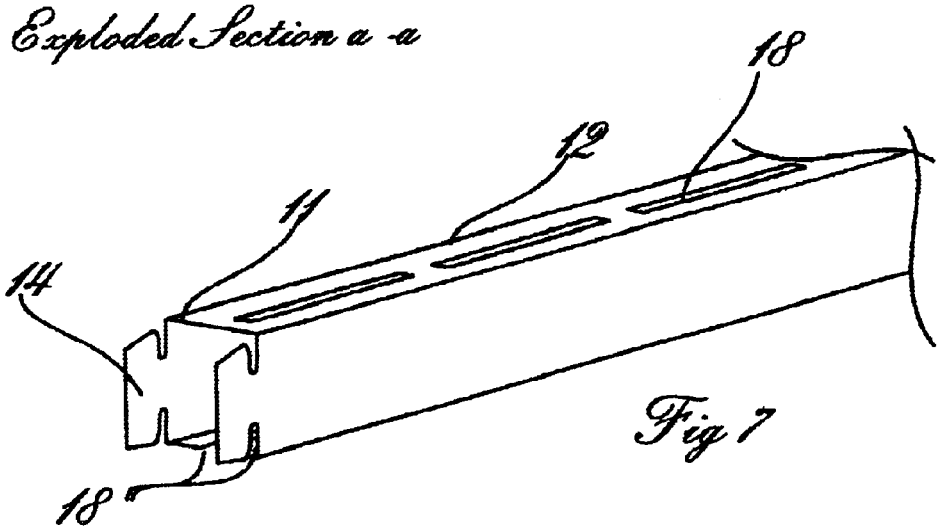

Referring to FIG. 7 it is shown how post members 10 and center and bottom rail members 11 are coupled.

Figure 3:
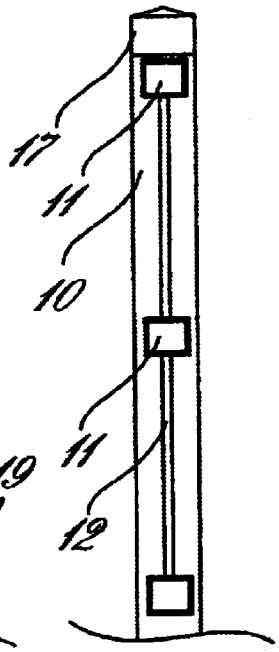
FIG. 3 illustrates a sectional view of a fence panel according to FIG. 1.
Figure 4:
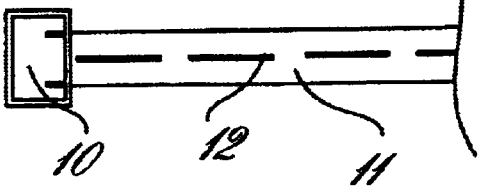
FIG. 4 illustrates a partial front section of a fence panel according to FIG. 1.

Referring to FIGS. 1, 3 and 5 it can be seen how paling member 12 can be inserted through the center and bottom rail members 11.

Figure 6:
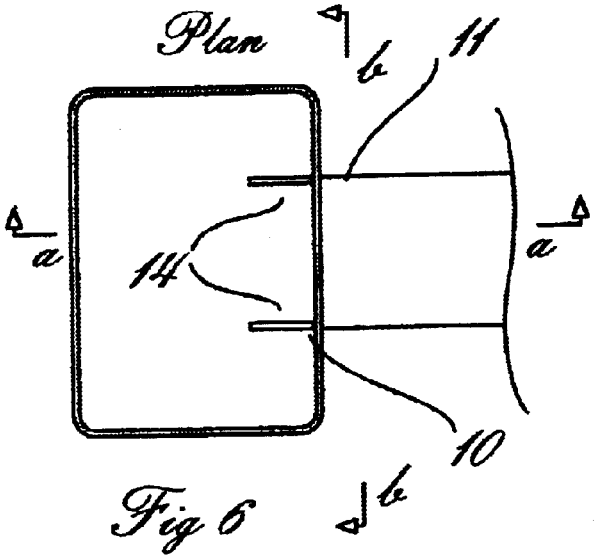
FIG. 6 illustrates a top view of a top rail member attached to a post according to FIG. 3.
Figure 8:
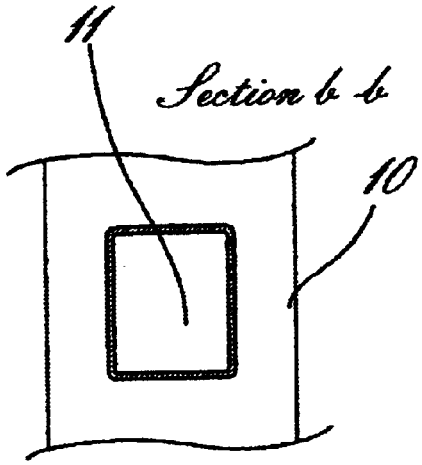
FIG. 8 illustrates a fragmented view of a post and rail member.

Referring to FIGS. 3 and 6 it is shown how top rail member 11 is inserted into the top of post member 10 to secure paling members 12 and to also lock paling members 12 into post member 10.

Figure 13:
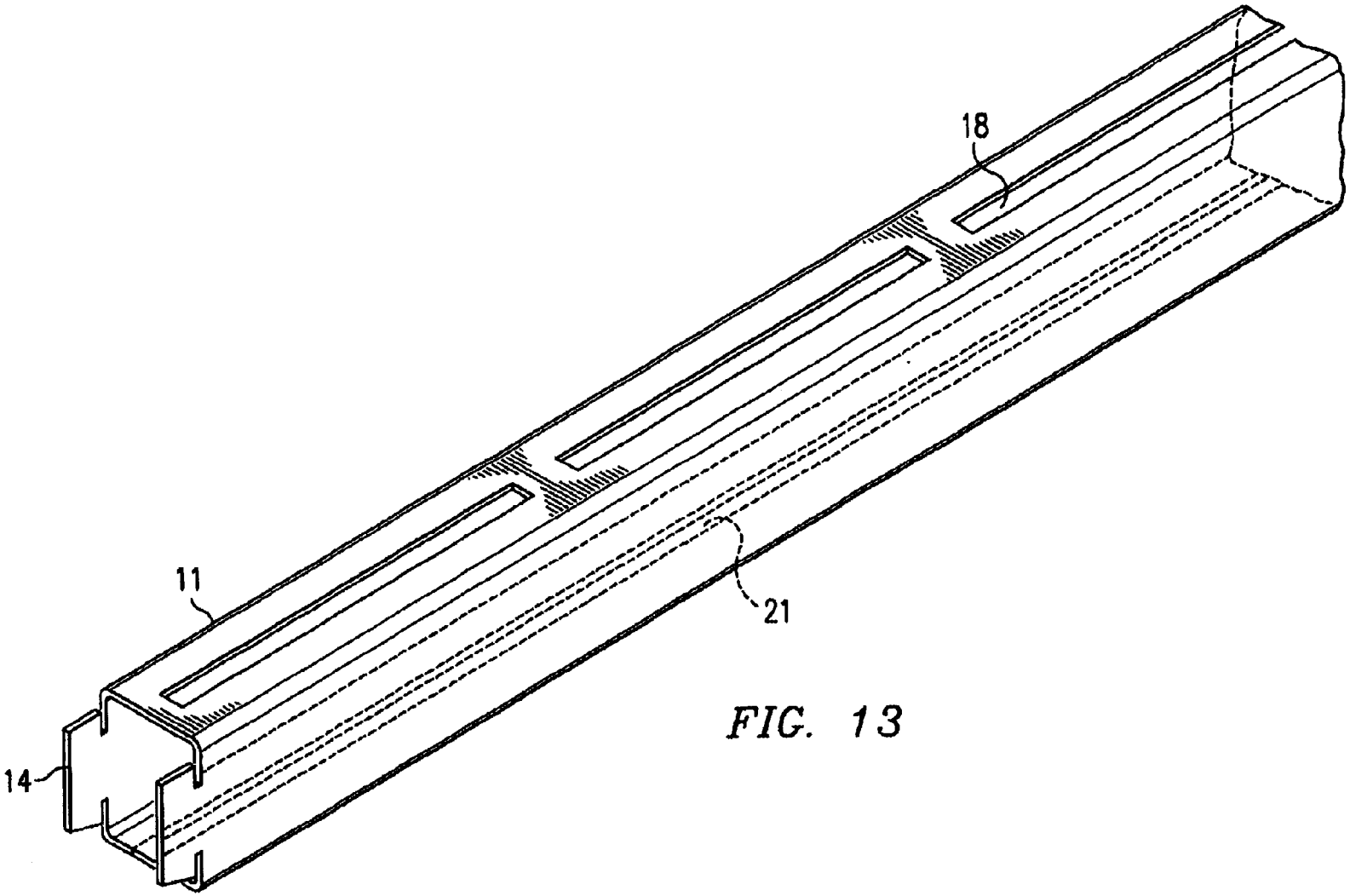
FIG. 13 depicts a rail member having a continuous tear out strip.

FIG. 13 depicts rail 11 having continuous tear our strip 19, hooked shaped projection 14 and opening 18.

It should be appreciated that various other minor changes and modifications may be made to the embodiment described without departing from the spirit and scope of the invention as claimed.

What is claimed:

1. A fence assembly comprising:

a plurality of post members, a plurality of top rail members, a plurality of center rail members, a plurality of bottom rail members, and a plurality of paling members;

wherein each of said post members has a plurality of post openings on at least one side;

wherein said top rail members, said center rail members and said bottom rail members connect to said post members by interlocking insertion of a plurality of hooked shape projections with the plurality of post member openings;

wherein each of said top rail members, said center rail members and said bottom rail members have a continuous tear out strip along the center of one edge;

wherein said hooked shape projections extend from and are of unitary construction with each end of said top rail members, said center rail members and said bottom rail members;

wherein the hooked shape projections permit each of said top rail members, said center rail members and said bottom rail members to be inverted and connected by interlocking insertion to said post members;

wherein each of said paling members connect to each of said top rails by insertion in a top rail continuous opening formed by removal of the top rail continuous tear out strip, to each of said center rails by insertion in a plurality of center rail openings and a center rail continuous opening formed by removal of the center rail continuous tear out strip, and to each of the bottom rail members by insertion in a plurality of bottom rail member openings.

2. The fence assembly of claim 1 wherein the plurality of post members locate in a plurality of post feet and are secured with a plurality of post wedges to enable the fence assembly to remain in a stationary position, and wherein a plurality of post caps connect to a plurality of tops of said post members.

3. The fence assembly of claim 1 wherein the top rail members, the center rail members and the bottom rail members, when connected to a post member, are substantially perpendicular with respect to the post member.

4. The fence assembly of claim 1 wherein the top rail members, the center rail members and the bottom rail members, when connected to the paling members, are substantially perpendicular with respect to the paling members.

5. The fence assembly of claim 1, wherein the post members are formed from a rectangular hollow section formed from metal, the paling members are formed from a pressed hardwood fiber, vinyl or plastic boards, the post feet are formed from concrete and the post wedges are formed from a composite material.

6. A method of constructing a fence assembly comprising:

using a plurality of post members having a plurality of post openings on opposing sides of each of said post members, a plurality of top rail members, center rail members and bottom rail members each having end projections shaped to permit said top rail members, said center rail members and said bottom rail members to be inserted into and locked into said post members, and the top rail members, the center rail members and the bottom rail members each have a top edge and a bottom edge, wherein each bottom edge has a continuous tear out strip and said top edges on the center rail members and the bottom members each have a plurality of rail openings that are positioned to be in alignment with the continuous opening made by removing the continuous tear out strip;

removing the tear out strip from each of the top rails and from each of the center rails to form a continuous opening along the bottom edges of each of the top rails and the center rails;

locking said center rail members and said bottom rail members into said posts;

dropping said paling members through said center and bottom rails;

aligning said top rail member over said paling members; and lowering said top rail member onto said paling members and locking said top rail member into said post member.

7. The method of claim 6 further comprising:

using a plurality of post feet, locating said post members in said post feet.

8. The method of claim 6 further comprising:

using a plurality of post caps, placing the plurality of post caps over a plurality of tops of the plurality of post members.

9. The method of claim 6 further comprising:

inserting a plurality of post wedges into a plurality of post feet to secure the post members at a required height.

10. The method of claim 6 further comprising:

leaving each of said tear out strips intact in each of the bottom rails intact to act as a stop for said paling members.

11. A fence assembly comprising:

a plurality of post members, a plurality of rail members, and a plurality of paling members;

wherein said rail members connect to said post members by interlocking insertion of a plurality of hooked shape projections with a plurality of post member openings;

wherein said hooked shaped projections extend from each end of said rails, arc of unitary construction with said rails and are adapted for locking said rails into said post member openings in a first position and in a second position;

wherein each of said rail members has a top edge and a bottom edge and wherein the bottom edge has a continuous tear out strip; and wherein the first position has the top edge facing up and the bottom edge facing down and the second position has the top edge facing down and the bottom edge facing up.

12. The fence assembly of claim 11 wherein said paling members connect to said rail members by insertion in a plurality of rail member openings.

13. The fence assembly of claim 12 wherein the plurality of rail members openings includes a plurality of continuous openings.

14. The fence assembly of claim 1 wherein said paling members have a thickness and a width complimentary to and substantially equal in dimension to the center rail openings, the bottom rail openings and the top rail continuous openings and the center rail continuous openings.

15. A fence assembly comprising:

a plurality of post members connected to a plurality of rail members; and a plurality of paling members connected to the plurality of rail members through a plurality of rail member openings and through a plurality of continuous tear out strips; and wherein each of said rail members has a top edge and a bottom edge and wherein the bottom edge has one of the plurality of continuous tear out strips; and wherein the first position bas the top edge facing up and the bottom edge facing down and the second position has the top edge facing down and the bottom edge facing up.

16. The fence assembly of claim 18 wherein a plurality of hooked shaped projections extend from each end of the rail members, that are of unitary construction with the rail members, and that are adapted for locking the rail members into a plurality of post member openings in a first position and in a second position.

* * * * *

UNITED STATES PATENT AND TRADEMARK OFFICE

CERTIFICATE OF CORRECTION

PATENT NO. : 6,772,998 B2
DATED : August 11, 2004
INVENTOR(S) : Bebendorf

It is certified that error appears in the above-identified patent and that said Letters Patent is hereby corrected as shown below:

Column 5,
Line 44, “arc” should be -- are --

Column 6,
Line 33, “bas” should be -- has --
Line 37, “18” should be --15 --

Signed and Sealed this

Fourteenth Day of September, 2004

JON W. DUDAS
*Director of the United States Patent and Trademark Office*